US010380887B2

(12) United States Patent
Takenaka et al.

(10) Patent No.: US 10,380,887 B2
(45) Date of Patent: Aug. 13, 2019

(54) DRIVING ASSIST SYSTEM

(71) Applicant: DENSO CORPORATION, Kariya, Aichi-pref. (JP)

(72) Inventors: Kazuhito Takenaka, Kariya (JP); Masumi Egawa, Kariya (JP); Utsushi Sakai, Kariya (JP); Kentaro Hitomi, Kariya (JP); Yuki Shinohara, Kariya (JP); Hideaki Misawa, Kariya (JP); Masataka Mori, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 179 days.

(21) Appl. No.: 15/646,867

(22) Filed: Jul. 11, 2017

(65) Prior Publication Data

US 2018/0018871 A1 Jan. 18, 2018

(30) Foreign Application Priority Data

Jul. 12, 2016 (JP) ..... 2016-137592

(51) Int. Cl.
*G08G 1/00* (2006.01)
*G08G 1/0962* (2006.01)
(Continued)

(52) U.S. Cl.
CPC ..... *G08G 1/0962* (2013.01); *G07C 5/02* (2013.01); *G08G 1/0112* (2013.01); *G08G 1/0129* (2013.01)

(58) Field of Classification Search
CPC .. G08G 1/0962; G08G 1/0112; G08G 1/0129; G07C 5/02
(Continued)

(56) References Cited

U.S. PATENT DOCUMENTS

2011/0087390 A1* 4/2011 Pandit ..... B60K 1/00 701/22
2011/0224893 A1* 9/2011 Scofield ..... G01C 21/3492 701/119
(Continued)

FOREIGN PATENT DOCUMENTS

JP 2007-133486 5/2007
JP 2008-059074 3/2008
(Continued)

*Primary Examiner* — Thomas G Black
*Assistant Examiner* — Wae L Louie
(74) *Attorney, Agent, or Firm* — Knobbe, Martens, Olson & Bear, LLP

(57) ABSTRACT

In a driving assist system, a driving evaluator compares a driving feature data item sampled at each predetermined sampling point and obtained from a target vehicle with historical driving data items for the corresponding sampling point. The driving evaluator obtains, based on a result of the comparison, an evaluation value of the driving feature data item for the target vehicle at each predetermined sampling point. An unusual driving determiner obtains a cumulative sum of selected values in the evaluation values of the driving feature data items for the target vehicle. The unusual driving determiner determines whether the cumulative sum is larger than a predetermined threshold, and determines that driving of a driver of the target vehicle is unusual upon determining that the cumulative sum is larger than the predetermined threshold.

10 Claims, 10 Drawing Sheets

(51) Int. Cl.
*G07C 5/02* (2006.01)
*G08G 1/01* (2006.01)

(58) Field of Classification Search
USPC ..... 701/22, 117, 119; 180/65.26, 65.28
See application file for complete search history.

(56) References Cited

U.S. PATENT DOCUMENTS

| | | | | |
|---|---|---|---|---|
| 2011/0313616 | A1* | 12/2011 | Tsuchikiri | B60W 50/0205 701/33.7 |
| 2012/0109721 | A1* | 5/2012 | Cebon | G06Q 30/06 705/13 |
| 2013/0096749 | A1* | 4/2013 | Hussain | B60K 6/46 701/22 |
| 2013/0302756 | A1* | 11/2013 | Takeuchi | F02D 41/1401 434/64 |
| 2017/0148311 | A1* | 5/2017 | Kashiwakura | G08G 1/0112 |
| 2019/0064027 | A1* | 2/2019 | Leone | G01M 1/28 |

FOREIGN PATENT DOCUMENTS

| | | |
|---|---|---|
| JP | 2012-247358 | 12/2012 |
| JP | 2012-247871 | 12/2012 |
| JP | 2013-250663 | 12/2013 |
| JP | 5375805 B2 | 12/2013 |
| JP | 2014-235605 | 12/2014 |

* cited by examiner

DRIVING ASSIST SYSTEM

CROSS REFERENCE TO RELATED APPLICATION

This application is based on and claims the benefit of priority from Japanese Patent Application No. 2016-137592 filed on Jul. 12, 2016, the disclosure of which is incorporated in its entirety herein by reference.

TECHNICAL FIELD

The present disclosure relates to technologies for assisting the driver's driving operations of a target vehicle.

BACKGROUND

Japanese Patent Publication No. 5375805 discloses a technology for assisting driver's driving operations of a target vehicle.

The technology, referred to as a published technology, prepares a database. In this database, driving operations by many drivers, referred to as sample drivers, which have been collected from many unspecified vehicles, are stored as historical driving-operation data. The many unspecified vehicles will be referred to as sample vehicles.

In particular, the driving operations by the sample drivers are categorized into plural groups in each of which the tendencies of the driving operations by corresponding sample drivers are similar to one another.

That is, the published technology selects one of the groups; the tendency of the driving operations by a target driver of the controlled target vehicle is similar to the tendencies of the driving operations by the corresponding sample drivers in the selected group.

Then, the published technology shows the driving operations in the selected group as guide information for the target driver. This prevents some driving operations by some sample drivers, whose tendencies are clearly different from the tendency of the driving operations by the target driver, from being guided as the guide information to the target driver.

SUMMARY

The published technology selects one of the groups; the tendency of the driving operations by a target driver of a controlled target vehicle is similar to the tendencies of the driving operations by the corresponding sample drivers in the selected group. This aims to reduce adverse effects, which are caused by the individual differences in driving operations between the sample drivers, reflected on the guide information to the target driver.

Unfortunately, the published technology may have difficulty in showing proper driving operations to a target driver as guide information if the target driver has an unusual or unique tendency of driving operations. Usually, the tendencies of driver's driving operations differ from region to region and/or culture to culture.

For this reason, if a target driver drives a vehicle in a region where the target driver usually does not drive, the target driver may have a specific tendency of driving operations in comparison to the tendencies of the driving operations, which are stored in the database, by the sample drivers who usually drive their vehicles in that region.

This therefore may result in improper guide information based on the driving operations stored in the database being provided to the target driver, because the tendencies of the driving operations stored in the database are different from the tendency of the driving operations of the target driver.

Additionally, such a target driver of a controlled target vehicle, who has a specific tendency of driving operations, may have difficulty in predicting the behaviors of other vehicles driven by other drivers. On the other hand, the other drivers also may have difficulty in predicting the behavior of the target vehicle driven by the target driver. The published technology however may make it hard to identify such a target driver having a specific tendency of driving operations.

In view of the circumstances set forth above, one aspect of the present disclosure seeks to provide driving assist systems, which are capable of addressing the problems set forth above.

Specifically, an alternative aspect of the present disclosure aims to provide such driving assist systems, each of which is capable of identifying a driver of a vehicle in a plurality of vehicles, who has an unusual tendency of driving operations; this tendency is different from the tendencies of driver's driving operations of peripheral vehicles in the plurality of vehicles; the peripheral vehicles are located around the identified vehicle.

According to an exemplary aspect of the present disclosure, there is provided a driving assist system. The driving assist system includes a data obtainer configured to obtain, from each of a plurality of vehicles, a driving feature data item sampled at each predetermined sampling point on a travelling route of the corresponding vehicle. The driving feature data items obtained from each of the plurality of vehicles are based on at least one of at least one driver's operation to the corresponding vehicle, and at least one behavior of the corresponding vehicle. The system includes a first storage unit storing, as historical driving data items, the driving feature data items that have been previously obtained from each of the plurality of vehicles. The historical driving data items obtained from each of the plurality of vehicles have been sampled at the respective sampling points on the corresponding travelling route. The system includes a driving evaluator configured to compare the driving feature data item sampled at each predetermined sampling point and obtained from a target vehicle included in the plurality of vehicles with the historical driving data items for the corresponding sampling point stored in the first storage unit. The driving evaluator is configured to obtain, based on a result of the comparison, an evaluation value of the driving feature data item for the target vehicle at each predetermined sampling point. The evaluation value of the driving feature data item for the target vehicle at each predetermined sampling point represents a degree of alienation of the driving feature data item from the historical driving data items at the corresponding sampling point. The system includes a second storage unit configured to store the evaluation value of the driving feature data item for the target vehicle at each predetermined sampling point. The system includes an unusual driving determiner configured to obtain a cumulative sum of selected values in the evaluation values of the driving feature data items for the target vehicle. The selected values correspond to respectively selected sampling points included in the sampling points. The unusual driving determiner is configured to determine whether the cumulative sum of the selected values in the evaluation values of the driving feature data items for the target vehicle is larger than a predetermined threshold. The unusual driving determiner is configured to determine that driving of a driver of the target vehicle is unusual upon determining that the cumulative sum of the selected values in the evaluation values of the driving feature data items for the target vehicle is larger than the predetermined threshold.

The driving assist system enables an unusual, i.e. specific, driver's driving of a target vehicle to be detected from the plurality of vehicles. This therefore enables assist information to draw attention to the unusual driving vehicle to be provided to the target vehicle itself and/or peripheral vehicles located around the target vehicle.

The driving assist system obtains an evaluation value of the driving feature data item for the target vehicle at each predetermined sampling point. The evaluation value of the driving feature data item for the target vehicle at each predetermined sampling point represents a degree of alienation of the driving feature data item from the historical driving data items at the corresponding sampling point. That is, the evaluation value of the driving feature data item for the target vehicle at each predetermined sampling point represents an instantaneous specific feature of a driver's driving of the target vehicle. The driving assist system also determines whether the cumulative sum of the selected values in the evaluation values of the driving feature data items for the target vehicle is larger than the predetermined threshold. This configuration prevents a driver's sudden unique operations caused by an ambient environment, such as a road environment, from being reflected on the determination of whether the driving of the driver of the target vehicle is unusual. This therefore enables the specificity of the driver of the target vehicle due to the driver's driving tendency to be properly identified.

The above and/or other features, and/or advantages of various aspects of the present disclosure will be further appreciated in view of the following description in conjunction with the accompanying drawings. Various aspects of the present disclosure can include and/or exclude different features, and/or advantages where applicable. In addition, various aspects of the present disclosure can combine one or more feature of other embodiments where applicable. The descriptions of features, and/or advantages of particular embodiments should not be construed as limiting other embodiments or the claims.

BRIEF DESCRIPTION OF THE DRAWINGS

Other aspects of the present disclosure will become apparent from the following description of embodiments with reference to the accompanying drawings in which.

DETAILED DESCRIPTION OF EMBODIMENT

Figure 1:
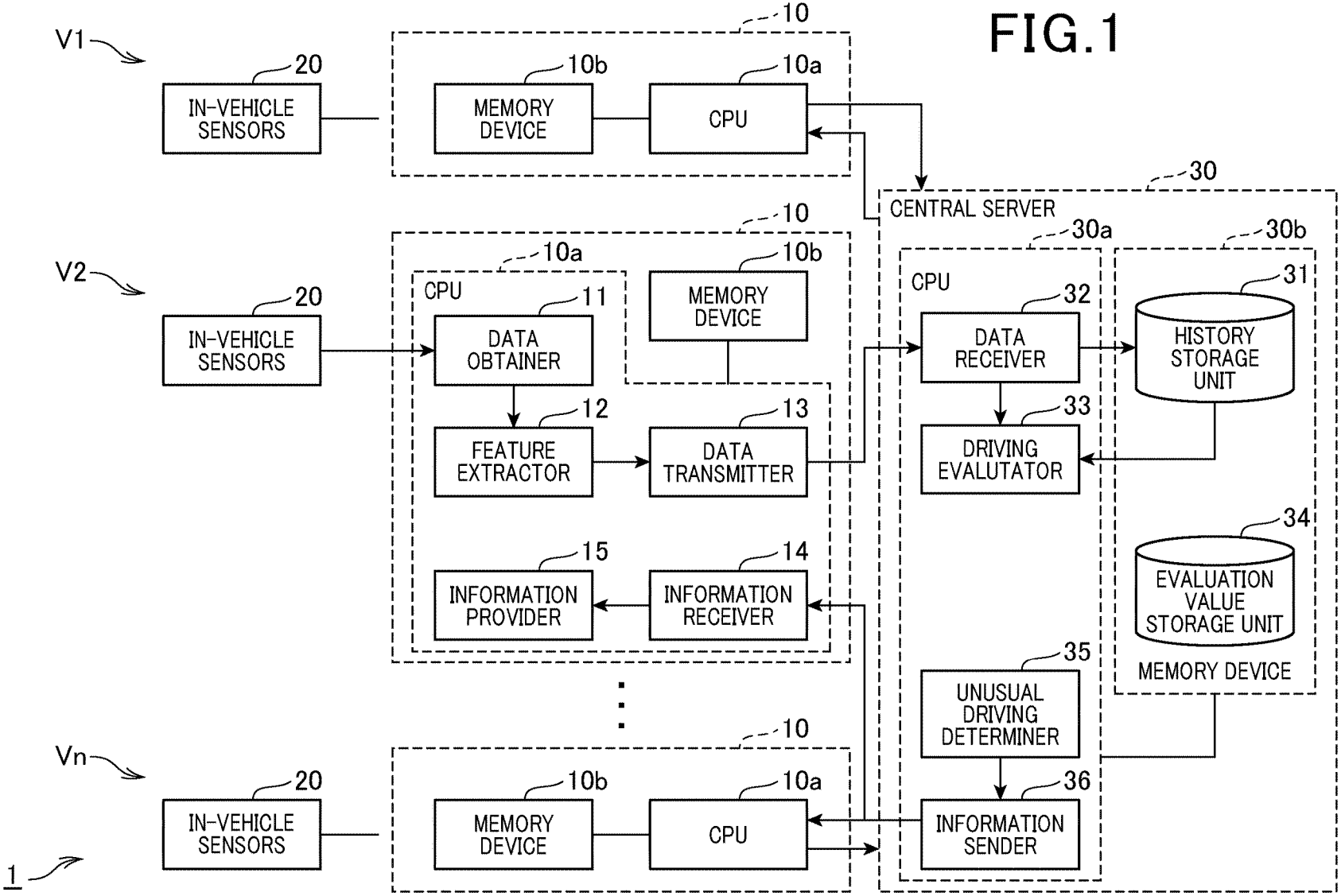
FIG. 1 is a block diagram schematically illustrating an example of the functional structure of a driving assist system according to the first embodiment of the present disclosure.

The following describes embodiments of the present disclosure with reference to the accompanying drawings. In the embodiments, like parts between the embodiments, to which like reference characters are assigned, are omitted or simplified to avoid redundant description.

First Embodiment

The following describes a driving assist system 1 according to the first embodiment of the present disclosure with reference to FIGS. 1 to 12.

Referring to FIG. 1, the driving assist system 1 includes in-vehicle units 10 respectively installed in a plurality of vehicles V1, . . . , Vn, and a central server 30 communicable by radio with the in-vehicle units 10.

Each of the in-vehicle units 10 is configured mainly as at least one known microcomputer including a CPU 10*a* and a memory device 10*b*. The memory device 10*b* includes, for example, at least one of semiconductor memories, such as a RAM, a ROM, and a flash memory. These semiconductor memories are non-transitory storage media.

For example, the CPU 10*a* of each in-vehicle unit 10 can run one or more programs, i.e. sets of program instructions, stored in the memory device 10*b*, thus implementing various functions of the in-vehicle unit 10 as software operations. In other words, the CPU 10*a* can run programs stored in the memory device 10*b*, thus performing one or more methods in accordance with the corresponding one or more programs. At least one of the various functions of at least one in-vehicle unit 10 can be implemented as a hardware electronic circuit. For example, the various functions of at least one in-vehicle unit 10 can be implemented by a combination of electronic circuits including digital circuits, which include many logic gates, analog circuits, digital/analog hybrid circuits, or hardware/software hybrid circuits.

Similarly, the central server 30 is configured mainly as at least one known microcomputer including a CPU 30*a* and a memory device 30*b*. The memory device 30*b* includes, for example, at least one of semiconductor memories, such as a RAM, a ROM, and a flash memory. These semiconductor memories are non-transitory storage media.

For example, the CPU 30*a* of the central server 30 can run one or more programs, i.e. program instructions, stored in the memory device 30*b*, thus implementing various functions of the central server 30 as software operations. In other words, the CPU 30*a* can run programs stored in the memory device 30*b*, thus performing one or more routines in accordance with the corresponding one or more programs. At least one of the various functions of the server 30 can be implemented as a hardware electronic circuit. For example, the various functions of at least one server 30 can be implemented by a combination of electronic circuits including digital circuits, which include many logic gates, analog circuits, digital/analog hybrid circuits, or hardware/software hybrid circuits.

Referring to FIG. 1, the in-vehicle unit 10 installed in each of the vehicles V1 to Vn includes a data obtainer 11, a feature extractor 12, a data transmitter 13, an information receiver 14, and an information provider 15. As described above, the CPU 10*a* of the in-vehicle unit 10 runs corresponding one or more programs stored in the memory device 10*b*, thus implementing the functional modules 10 to 15.

The data obtainer 11 is communicably connected to sensors, in-vehicle sensors, 20 installed in the corresponding vehicle.

The in-vehicle sensors 20 include a first type of sensors each repeatedly measuring a driving behavioral data item including at least one of 1. A driver's operation of a corresponding one of driver-operable devices installed in the corresponding vehicle travelling on each of predetermined travelling routes 2. A behavior of the corresponding vehicle travelling on each of the predetermined travelling routes The data obtainer 11 obtains, from each of the first type of sensors, a driving-behavioral data sequence consisting of the corresponding one of the sequentially or cyclically measured driving behavioral data items, i.e. driving behavioral data items (see FIG. 2).

For example, the driving behavioral data items include

1. The quantity or state of a driver's operation of a driver-operable gas pedal of the corresponding vehicle linked to a throttle valve 2. The pressure of brake fluid in hydraulic brake systems (not shown) in the corresponding vehicle 3. The steering angle of the corresponding vehicle 4. The speed of the corresponding vehicle 5. The acceleration of the corresponding vehicle 6. The yaw rate of the corresponding vehicle The in-vehicle sensors 20 also include a second type of sensors, such as radar sensors and weather sensors, each repeatedly measuring a piece of environment information including one of 1. Object information, such as relative positional information, about objects including, for example, other vehicles, pedestrians, and obstacles located around the corresponding vehicle 2. Weather information indicative of a weather condition, such as a shine, i.e. fine condition or a rain condition around the corresponding vehicle (see FIG. 2)

Figure 2:
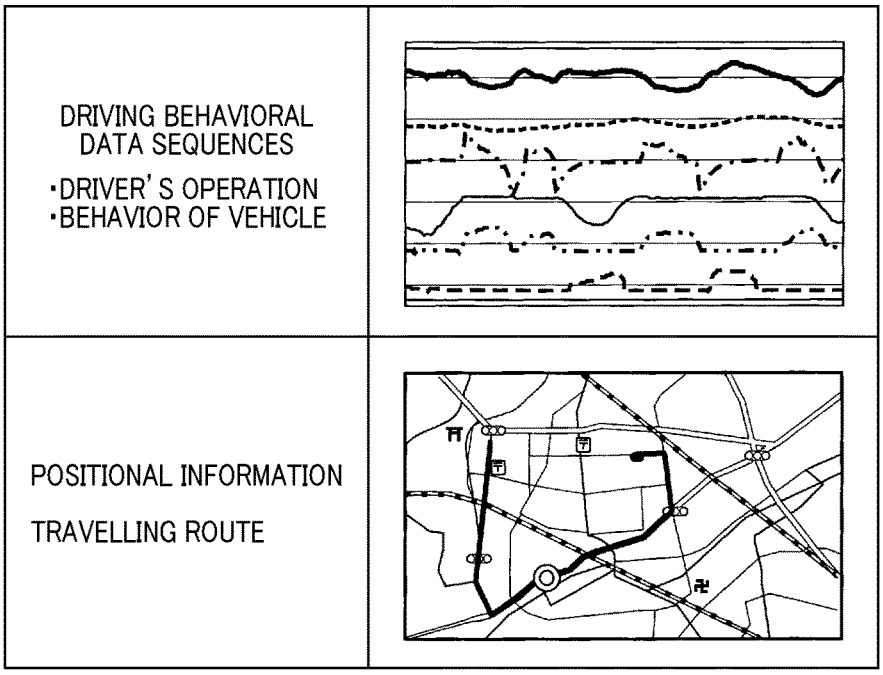
FIG. 2 is a diagram schematically illustrating an example of driving behavioral data sequences, positional information, and a travelling route.

The data obtainer 11 obtains, from each of the second type of sensors, the corresponding piece of the environment information (see FIG. 2).

The in-vehicle sensors 20 further include a third type of sensors, such as a global positioning systems (GPS) receiver and a navigation system, each repeatedly measuring a piece of positional/time information including one of 1. Current time 2. Current location of the corresponding vehicle 3. A current travelling direction of the corresponding vehicle 4. A travelling route on which the corresponding vehicle is travelling to a driver's input destination The data obtainer 11 obtains, from each of the third type of sensors, the corresponding piece of the positional/time information.

Figure 3:
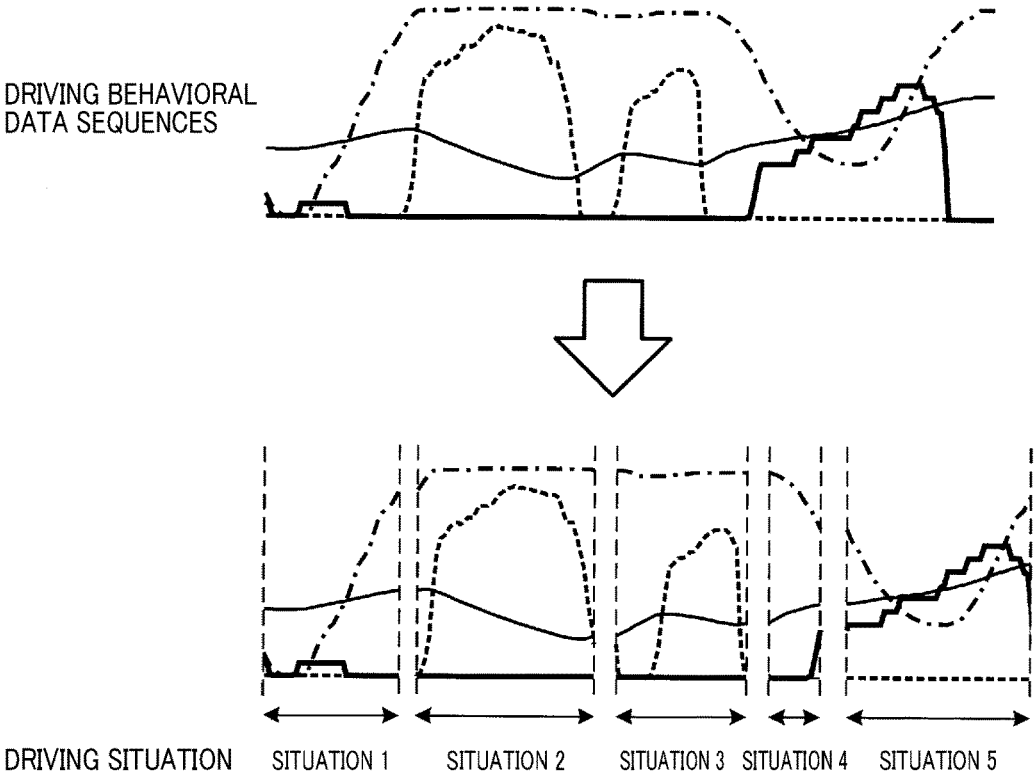
FIG. 3 is a diagram schematically illustrating how a feature extractor illustrated in FIG. 1 works.

Referring to FIG. 3, the feather extractor 12 includes a driver model that simulates driving operations, i.e. cruising operations, of drivers and recognition operations of the environments around each driver. The feature extractor 12 statistically analyzes the driving behavioral data sequences output from the data obtainer 11. This statistic analysis extracts each point of time where a common driver feels change of a current driving situation to another driving situation.

The driving situations represent organized driving conditions and driving environments of a vehicle. For example, each of the driving situations represents various items of information indicative of how the driver drives a vehicle under what kind of environments around the vehicle.

According to the results of extraction, the feature extractor 12 discretizes the driving behavioral data sequences into a plurality of segmented behavior-data sequences; each of the segmented behavior-data sequences belongs to a corresponding one of the driving situations. In other words, the feature extractor 12 extracts the sequence of time sections, each of which matches with a corresponding one of the segmented behavior-data sequences.

For example, the feature extractor 12 uses a double articulation analyzer (DAA) to perform such discretization in accordance with an unsupervised driving-situation partitioning method using a double articulation structure. In the DAA, various vehicle states obtained from many time-series driving behavioral data sequences in a multidimensional data space representing a range of each of the time-series driving behavioral data sequences are defined as clusters. In addition, predetermined values are determined as respective transition probabilities among the clusters. The DAA includes information about the clusters and the transition probabilities among the clusters.

According to the information, the DAA performs a statistical analysis that divides the driving behavioral data sequences obtained by the data obtainer 11 into a plurality of subsets each belonging to a corresponding one of the vehicle states, i.e. clusters. Then, the DAA assigns predetermined identification symbols to the respective clusters, thus converting the driving behavioral data sequences into a symbol sequence.

For example, the DAA can generate a symbol sequence corresponding to the driving behavioral data sequences using a Hierarchical Dirichlet Process-Hidden Markov Model (HDP-HMM) as one of models each designed based on a predetermined number of hidden states, i.e. vehicle states, and transition probabilities among the hidden states. The HDP-HMM uses the clusters that were previously determined based on learning, and uses the transition probabilities among the clusters that were previously determined.

Next, the DAA uses a nested Pitman-Yor language model (NPYLM) as an example of an data transmitter unsupervised chunking method for discrete character strings using statistic information to convert the symbol sequence into the segmented sequences, i.e. segmented symbol sequences, each corresponding to one of the driving situations, i.e. the driving situations (see SITUATION 1, SITUATION 2, SITUATION 3, SITUATION 4, and SITUATION 5 in FIG. 3). While converting the symbol sequence into the segmented symbol sequences, the DAA maximizes an occurrence probability of the whole of the segmented symbol segments. This causes the driving behavioral data sequences to become a plurality of segmented behavior-data sequences each corresponding to one of the predetermined driving situations. Note that the DAA uses the transition probabilities among the driving situations that were previously calculated based on learning, and uses an occurrence probability of each driving situation that was previously calculated based on learning.

Note that the feature extractor 12 can obtain the segmented behavior-data sequences using one of other analyzers except for the DAA, and specific models in other models except for the HDP-HMM and NPYLM.

U.S. Pat. No. 9,527,384 and Japanese Patent Application Publication 2013-250663 disclose such known coding technology for extracting, from the driving behavioral data sequences, the driving situations, i.e. driving scenes. The disclosure of each of U.S. Pat. No. 9,527,384, which is referred to as a US patent document, and JP 2013-250663 is incorporated entirely herein by reference. The feature extractor 12 can extract, from the driving behavioral data sequences, the driving situations in accordance with predetermined extraction rules including, for example, a rule that the state where the corresponding vehicle being stopped is taken as one driving situation.

Additionally, the feature extractor 12 extracts, from each of the segmented behavior-data sequences, in other words, from each of the driving situations, a feature data item representing features of the corresponding driving situation.

The feature extractor 12 is configured to use topic proportions as the feature data items.

For example, the feature extractor 12 includes a feature distribution obtainer 12*a*, a driving-topic database 12*b*, and a topic proportion calculator 12*c*.

The feature distribution obtainer 12*a* generates a distribution of features included in each of the segmented behavior-data sequences, in other words, included in each of the driving situations.

For example, each of the segmented behavior-data sequences include first to M-th feature sequences, each of which represents change of the corresponding driver's operation or the corresponding behavior of the corresponding vehicle.

Each of the first to M-th feature sequences has a corresponding range from a lower limit to an upper limit.

The feature distribution obtainer 12*a* uses the range of each of the first to M-th feature sequences as a corresponding feature space, and generates a distribution of each of the first to M-th feature sequences in a corresponding one of the feature spaces.

The driving-topic database 12*b* has stored therein information indicative of a plurality of driving topics. Each of the driving topics represents a corresponding basic driving situation that frequently appears while a vehicle is travelling.

Each of the driving topics is composed of n base feature-quantity distributions whose number n is identical to the number of the feature distributions included in each of the driving situations. The n base feature distributions can be referred to as the first base feature distribution (first base distribution) 1, . . . , and the n-th base feature distribution (n-th base distribution) n.

The information indicative of the driving topics is used to express the group of the first to n-th feature distributions for each of the driving conditions as a combination of at least some of the driving topics.

The US patent document set forth above and Japanese Patent Application Publication No. 2014-235605 disclose how to generate the driving topics. The disclosure of each of US patent document and JP 2014-235605 is incorporated entirely herein by reference.

As described above, each of the driving topics based on a corresponding group of the first to n-th base feature distributions set forth above represents a corresponding specific driving situation that latently, i.e. potentially, exists in corresponding driving behavioral data sequences, and that frequently appears while a driver is driving the corresponding vehicle.

The topic proportion calculator 12*c* is configured to

1. Select some driving topics in all the driving topics stored in the database 12*a* for each of the driving situations; the selected driving topics are required to express the first to n-th feature distributions, i.e. typical feature patterns, included in the corresponding driving situation 2. Calculate the percentages of the selected driving topics with respect to the whole of the selected driving topics such that the mixture of the calculated percentages of the selected driving topics most suitably express the first to n-th feature distributions included in the corresponding driving situation, thus generating a topic proportion based on the percentages of the selected driving topics for each of the driving situations (see FIG. 4).

The data transmitter 13 cyclically sends the topic proportion, i.e. the feature data item, for each of the driving situations extracted by the feature extractor 12, to the central server 30 together with index information including the environment information and the position/time information. The feature data item to which the environment information and the position/time information are attached will be referred to as a driving data item.

For example, the data transmitter 13 sends the driving data item for each of the driving situations to the central server 30 each time the corresponding vehicle travels at one of predetermined sampling points on a drivable road; the intervals of the predetermined sampling points are each set to, for example, several meters or several dozen meters. The data sender 13 can divide at least one of the sampling points into sub sampling points, combine at least two of the sampling points with each other based on the driving situations extracted by the feature extractor 12.

The information receiver 14 receives assist information sent from the central server 30; the assist information assists a driver of the corresponding vehicle to address one of the vehicles V1 to Vn whose driver has a specific tendency, i.e. unusual tendency, of cruising operations, i.e. driving operations, of the corresponding one of the vehicles V1 to Vn.

The information provider 15 includes, for example, an audio output unit and/or display, and is capable of providing, to a driver of the corresponding vehicle, the assist information as audible and/or visible information using the audio output unit and/or display, such as a head-up display.

Referring to FIG. 1, the central server 30 includes a data receiver 32, a driving evaluator 33, an unusual driving determiner 35, and an information sender 36; the CPU 30*a* runs corresponding one or more programs stored in the memory device 30*b*, thus implementing the functional modules 32, 33, and 35. The central server 30 also includes a history storage unit 31 and an evaluation storage unit 34; predetermined storage areas of the memory device 30*b* are allocated to serve as the respective history storage unit 31 and evaluation storage unit 34.

The data receiver 32 receives the driving data item each time the driving data item is sent from the data transmitter 13 of the in-vehicle unit 10 of each of the vehicles V1 to Vn. Then, the data receiver 32 stores the driving data items in the history storage unit 31. That is, the driving data items, which are measured from the vehicles V1 to Vn at each of the sampling points, are stored in the history storage unit 31 to correlate with the corresponding one of the sampling points as historical driving data items at the corresponding one of the sampling points.

The data receiver 32 also supplies the driving data items at each of the sampling points to the driving evaluator 33.

Figure 4:
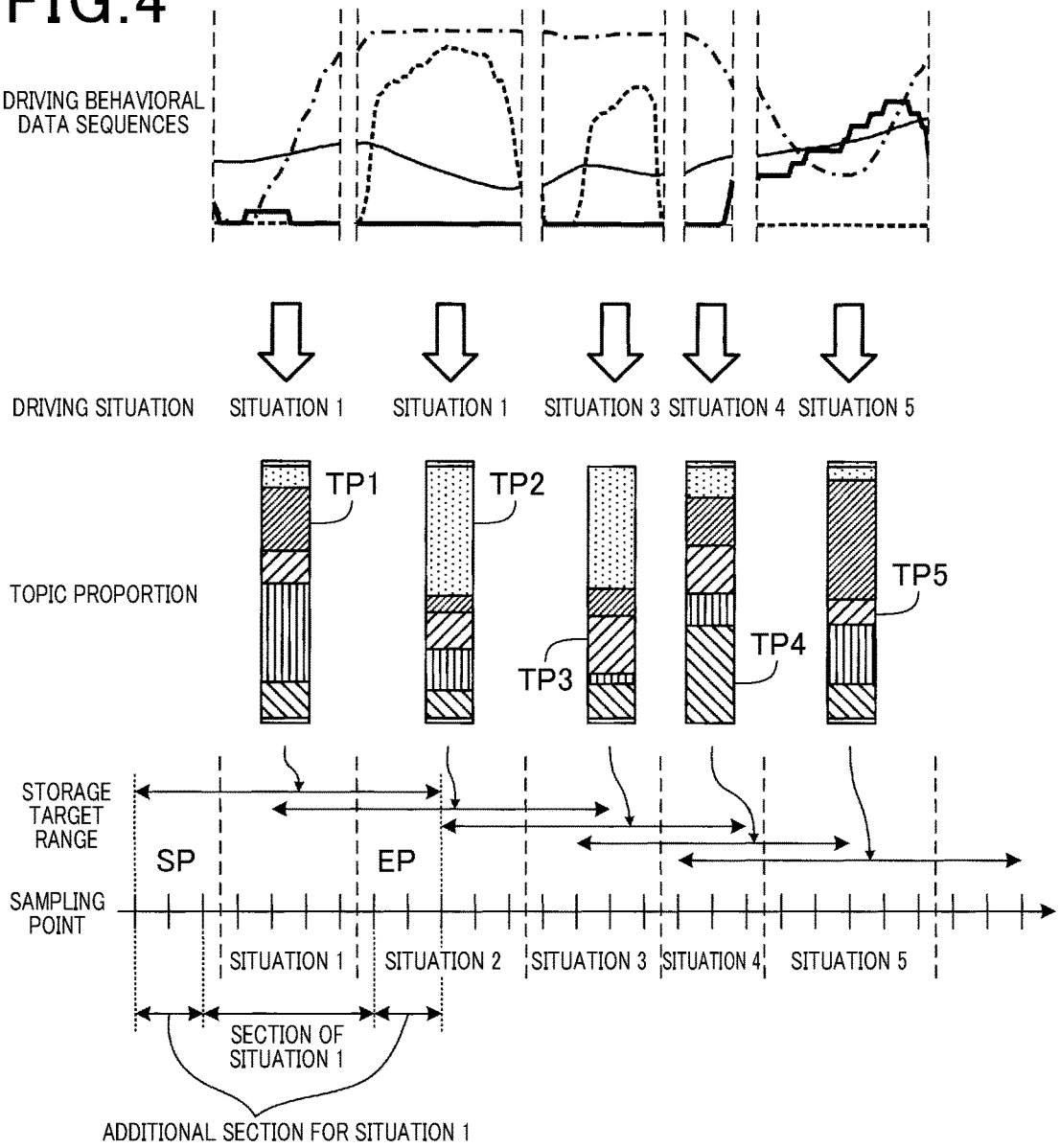
FIG. 4 is a diagram schematically illustrating how the feature extractor and a feature receiver illustrated in FIG. 1 work.
Figure 5:
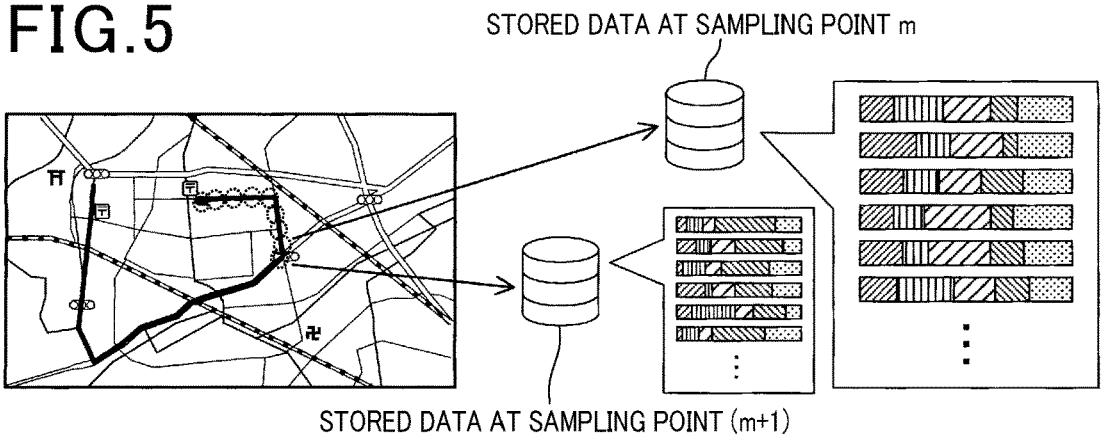
FIG. 5 is a diagram schematically illustrating an example of historical driving data items stored in a history storage unit.

FIG. 4 schematically illustrates an example of the relationship between the sampling points, at each of which the driving data item is obtained to be stored in the history storage unit 31, and the driving situations 1, 2, . . . , 5 corresponding to the respective topic proportions (see TP1, TP2, . . . , TP5 in FIG. 4) as a typical example of topic proportions.

FIG. 4 shows that the intervals between the sampling points are shorter than the length of a typical driving situation. For this reason, the driving data item for a driving situation is stored in the history storage unit 31 as the historical driving data items for each of plural sampling points corresponding to the driving situation.

Additionally, a timing at which a driving situation is switched to another driving situation varies for individual drivers. From this viewpoint, the driving assist system 1 according to the first embodiment is specially configured as follows.

Specifically, a sampling point, which corresponds to the start of each driving situation, and a sampling point, which corresponds to the end of the corresponding driving situation, are respectively defined as a start sampling point and an end sampling point. That is, as illustrated in FIG. 4, the driving situation 1 has the start sampling point SP and the end sampling point EP.

At that time, the information receiver 32 is configured to store

1. The driving data item corresponding to the driving situation 1 to correlate with each of several sampling points before the start sampling point SP 2. The driving data item corresponding to the driving situation 1 to correlate with each of several sampling points after the end sampling point EP As a result, driving data items, i.e. driving topics, for respective driving situations are stored in the history storage unit 31 to correlate with a sampling point m as a historical driving data item at the sampling point m (see FIG. 5). Similarly, driving data items, i.e. driving topics, for respective driving situations are stored in the history storage unit 31 to correlate with a sampling point (m+1) as a historical driving data item at the sampling point (m+1) (see FIG. 5).

The driving evaluator 33 performs, for each of the vehicles V1 to Vn, a driving evaluation routine. The driving evaluation routine includes a task of calculating a distance between the feature data item included in the driving data item at each sampling point supplied from the data receiver 32 and the historical driving data items stored in the history storage unit 31 to correlate with the corresponding sampling point.

Figure 6:
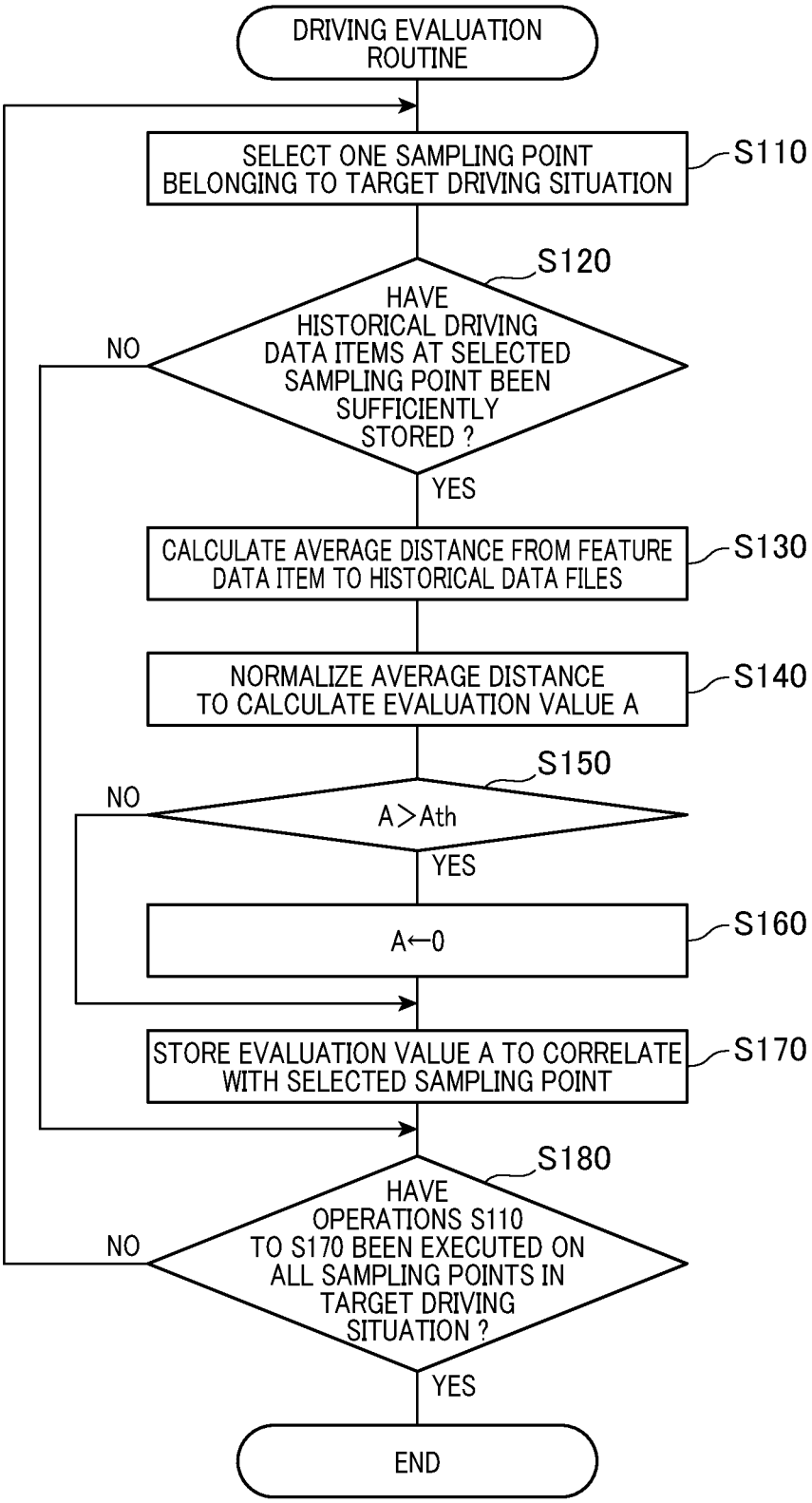
FIG. 6 is a flowchart schematically illustrating an example of a driving evaluation routine carried out by a central server illustrated in FIG. 1.

The following describes in detail an example of the driving evaluation routine with reference to FIG. 6 assuming that the driving data item includes a single driving situation as a target driving situation. If the driving data item includes plural driving situations as target driving situations, the driving evaluator 33 performs the driving evaluation routine for each of the target driving situations.

The CPU 30*a*, which serves as the driving evaluator 33, selects one of the sampling points belonging to the target driving situation as a selected sampling point in step S110.

Next, the CPU 30*a* determines whether sufficient historical driving data items at the selected sampling point have been stored in the history storage unit 31 in step S120. Specifically, the CPU 30*a* determines whether the number of the historical driving data items at the selected sampling point is equal to or more than a predetermined number, such as 30. When it is determined that the number of the historical driving data items at the selected sampling point is equal to or more than the predetermined number (YES in step S120), the CPU 30*a* determines that the historical driving data items at the selected sampling point have been sufficiently stored in the history storage unit 31. Then, the driving evaluation routine proceeds to step S130.

Otherwise, when it is determined that the number of the historical driving data items at the selected sampling point is less than the predetermined number (NO in step S120), the CPU 30*a* determines that the historical driving data items at the selected sampling point have not been sufficiently stored in the history storage unit 31. Then, the driving evaluation routine proceeds to step S180.

In step S130, the CPU 30*a* calculates an average distance from the feature data item at the selected sampling point to the historical driving data items at the selected sampling point. The average distance from the feature data item to the historical driving data items represents, for example, a parameter indicative of the degree of alienation, i.e. the degree of difference or dissimilarity, from the feature data item to the historical driving data items.

Figure 7:
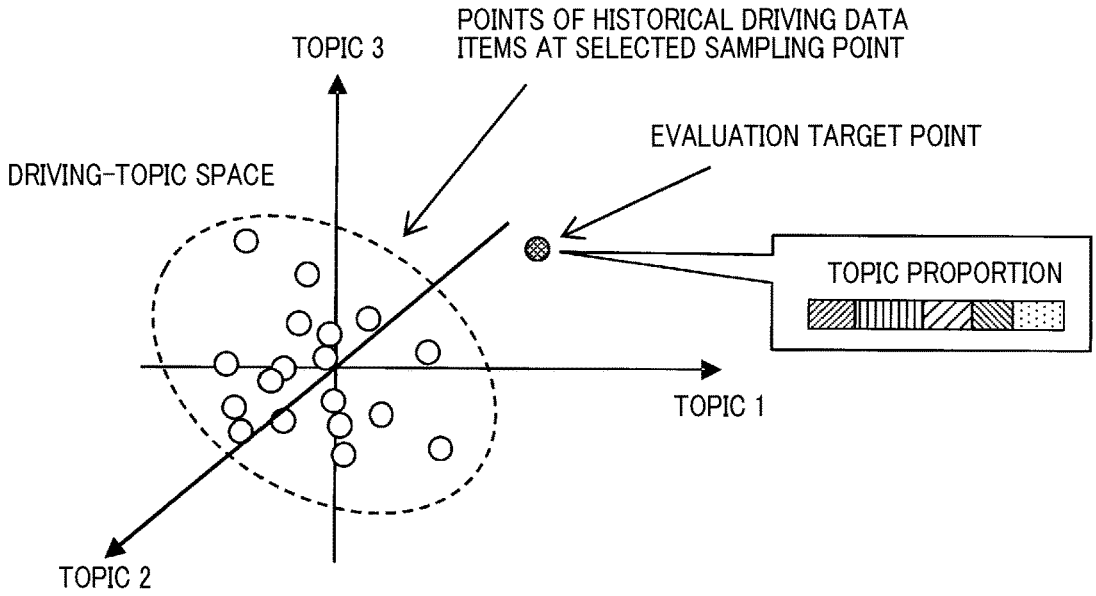
FIG. 7 is a diagram schematically illustrating that a feature data item at a selected sampling point and historical driving data items at the selected sampling point are expressed as respective points in a three-dimensional space.

Specifically, FIG. 7 conceptually illustrates that the feature data item at the selected sampling point is expressed as a point in a multidimensional space based on the driving topics. In FIG. 7, a three-dimensional space based on the number of driving topics being set to three, such as driving topic 1, driving topic 2, and driving topic 3, is illustrated as an example of the multidimensional space.

How the CPU 30*a* calculates the average distance from the feature data item, which is also referred to as an evaluation target point, at the selected sampling point for the target driving situation to the historical driving data items, which are also referred to as historical driving data points, at the selected sampling point is defined as follows.

Figure 8:
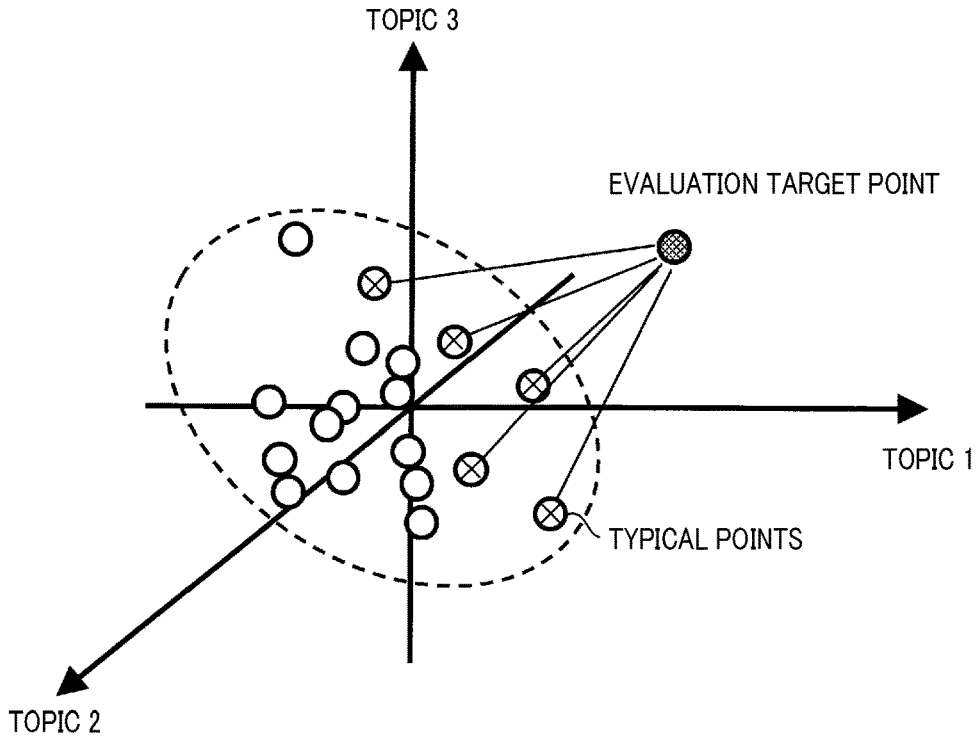
FIG. 8 is a diagram schematically illustrating the distances between an evaluation target point and representative points as an average value between the feature data item and the historical driving data items.

Specifically, as illustrated in FIG. 8, the CPU 30*a* selects, from the historical driving data points, a predetermined number of points in order from the closest to the evaluation target point as representative points. Then, the CPU 30*a* calculates an average value of the distances between the evaluation target point and the representative points as the average value between the feature data item and the historical driving data items.

Note that the CPU 30*a* can compare an angle of each of the historical driving data points from the origin of the three-dimensional space to the angle of the target point to thereby calculate the cosine distances between the respective historical driving data points and the target point. Then, the CPU 30*a* can select at least one point or a predetermined number of points of the historical driving data points; the selected point(s) have the closest cosine distance.

Following the operation in step S130, the CPU 30*a* calculates the degree of dispersion in the historical driving data points, such as the standard deviation of the historical driving data points in step S140. Then, in step S140, the CPU 30*a* normalizes the average distance calculated in step S130 by dividing the average distance by the standard deviation, thus obtaining an evaluation value A for the selected sampling point in the target driving situation for the corresponding vehicle.

That is, the lower the degree of dispersion in the historical driving data points at the selected sampling point is, the higher the similarity between the driver's drives of the vehicles V1 to Vn is. In contrast, the higher the degree of dispersion in the historical driving data points at the selected sampling point is, the lower the similarity between the driver's drives of the vehicles V1 to Vn is. In other words, a low value of the degree of dispersion in the historical driving data points at the selected sampling point represents that the driver's driving of the vehicles V1 to Vn at the selected sampling point are similar to each other. In contrast, a high value of the degree of dispersion in the historical driving data points at the selected sampling point represents that the driver's driving of the vehicles V1 to Vn at the selected sampling point vary from one another.

That is, let us consider a case where a first average value of the distances between a first evaluation target point and the representative points is identical to a second average value of the distances between a second evaluation target point and the representative points.

In this case, if the degree of the dispersion of the representative points for the first average value is lower than the degree of the dispersion of the representative points for the second average value, the specificity of the first evaluation target point to the historical driving data points is larger than the specificity of the second evaluation target point to the historical driving data points.

In contrast, if the degree of the dispersion of the representative points for the first average value is higher than the degree of the dispersion of the representative points for the second average value, the specificity of the first evaluation target point to the historical driving data points is smaller than the specificity of the second evaluation target point to the historical driving data points.

The evaluation value A is calculated based on the above theory.

Following the operation in step S140, the CPU 30*a* determines whether the evaluation value A calculated in step S140 is larger than a predetermined dead-zone threshold Ath in step S150. When it is determined that the evaluation value A calculated in step S140 is larger than the predetermined dead-zone threshold Ath (YES in step S150), the CPU 30*a* determines that the evaluation value A is out of a predetermined dead zone. Then, the driving evaluation routine proceeds to step S170.

Otherwise, when it is determined that the evaluation value A calculated in step S140 is equal to or smaller than the predetermined dead-zone threshold Ath (NO in step S150), the CPU 30*a* determines that the evaluation value A is within the predetermined dead zone. Then, the driving evaluation routine proceeds to step S160. In step S160, the CPU 30*a* sets the evaluation value A at the selected sampling point to zero. Then, the driving evaluation routine proceeds to step S170.

In step S170, the CPU 30*a* stores, in the evaluation storage unit 34, the evaluation value A at the selected sampling point in the target driving situation for each of the vehicles V1 to Vn to correlate with the selected sampling point and the corresponding index information.

Next, the CPU 30*a* determines whether the above operations in steps S110 to S170 have been executed on all the sampling points included in the target driving situation in step S180.

Upon determining that at least one sampling point included in the target driving situation has not been subjected to the above operations in steps S110 to S170 (NO in step S180), the CPU 30*a* returns to step S110, and performs the above operations in steps S110 to S170 for at least one sampling point included in the target driving situation.

Otherwise, upon determining that all the sampling points included in the target driving situation have been subjected to the above operations in steps S110 to S170 (YES in step S180), the CPU 30*a* terminates the driving evaluation routine.

Execution of the driving evaluation routine set forth above enables, for each of the vehicles V1 to Vn, the evaluation values A obtained for the respective sampling points in the target driving situation on the travelling route of the corresponding vehicle to be stored.

Note that the CPU 30*a* can be configured to delete at least one of the evaluation values A when a predetermined time has elapsed since the at least one of the evaluation values A was stored in the evaluation storage unit 34. The CPU 30*a* is communicably connected to an engine ECU of each of the vehicles V1 to Vn. The CPU 30*a* can be configured to delete, each time a startup signal indicative of an internal combustion engine of at least one vehicle has been completely started is input thereto from the engine ECU, one or more evaluation values for the at least one vehicle that were stored in the evaluation storage unit 34 before the input of the startup signal to the CPU 30*a*.

The unusual driving determiner 35 performs an unusual driving determining routine to determine, for each of the vehicles V1 to Vn, whether a corresponding driver is driving the corresponding vehicle in a specific way, i.e. a unique way, based on the corresponding evaluation values A stored in the evaluation storage unit 34.

Figure 10:
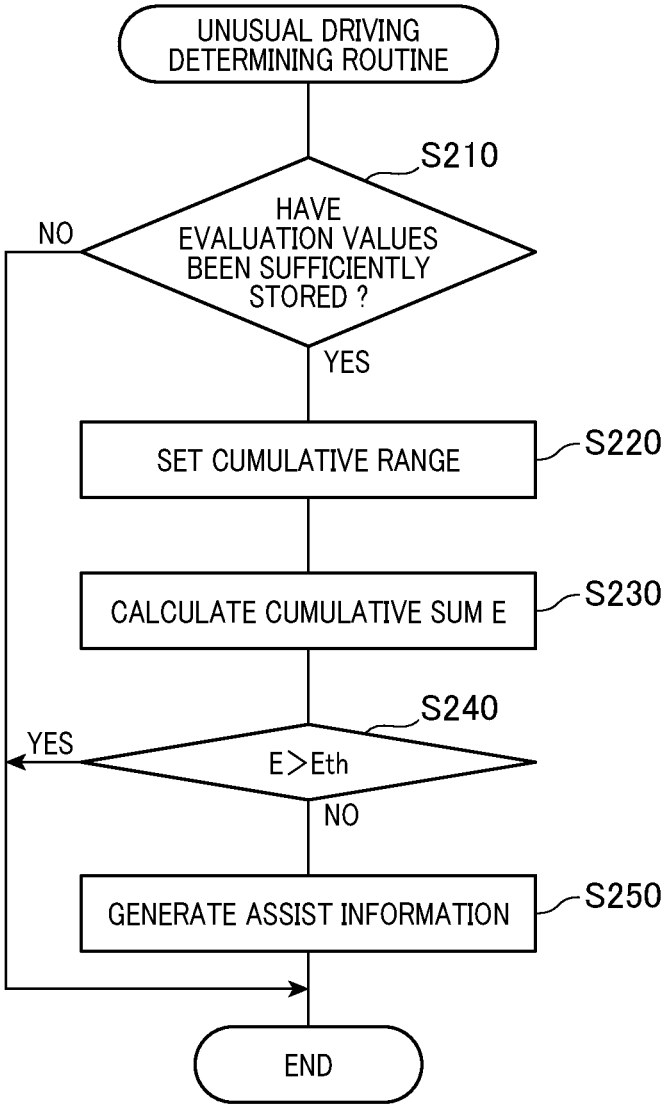
FIG. 10 is a flowchart schematically illustrating an example of an unusual driving determining routine carried out by the central server.

The following describes in detail an example of the unusual driving determining routine with reference to FIG. 10 for a selected one of the vehicles V1 to Vn as a target vehicle.

The CPU 30*a*, which serves as the unusual driving determiner 35, determines whether the number of the evaluation values A for the target vehicle A has reached a predetermined sufficient number in step S210.

When it is determined that the number of the evaluation values A for the target vehicle A has not reached the predetermined sufficient number (NO in step S210), the CPU 30*a* terminates the specificity determining routine.

Otherwise, when it is determined that the number of the evaluation values A for the target vehicle A has reached the predetermined sufficient number (YES in step S210), the specificity determining routine proceeds to step S220.

In step S220, the CPU 30*a* sets a cumulative range to the evaluation values A stored in the evaluation storage unit 34 for calculating a cumulative sum of the evaluation values A. For example, the CPU 30*a* sets, as the cumulative range, the range from the newest evaluation value A to a previous X-th evaluation value A relative to the newest evaluation value A; X is an integer equal to or more than 1. The CPU 30*a* can set, as the cumulative range, a range corresponding to one duration of the internal combustion engine from its start up to its stop, and use the evaluation values A obtained in the range for specificity determination of the target vehicle.

If a navigation system installed in the target vehicle establishes a suitable route for the current location of the target vehicle to a desired destination, the CPU 30*a* can set, as the cumulative range, a range corresponding to the suitable routine, and use the evaluation values A obtained in the range for specificity determination of the target vehicle.

The CPU 30*a* can set, as the cumulative range, a range corresponding to a predetermined travelling route except for a predetermined section, and use the evaluation values A obtained in the range except for the predetermined section for specificity determination of the target vehicle. The section in the range is configured such that all drivers drive in a specific way, i.e. unusual way, within the section, such as a construction section.

Figure 9:
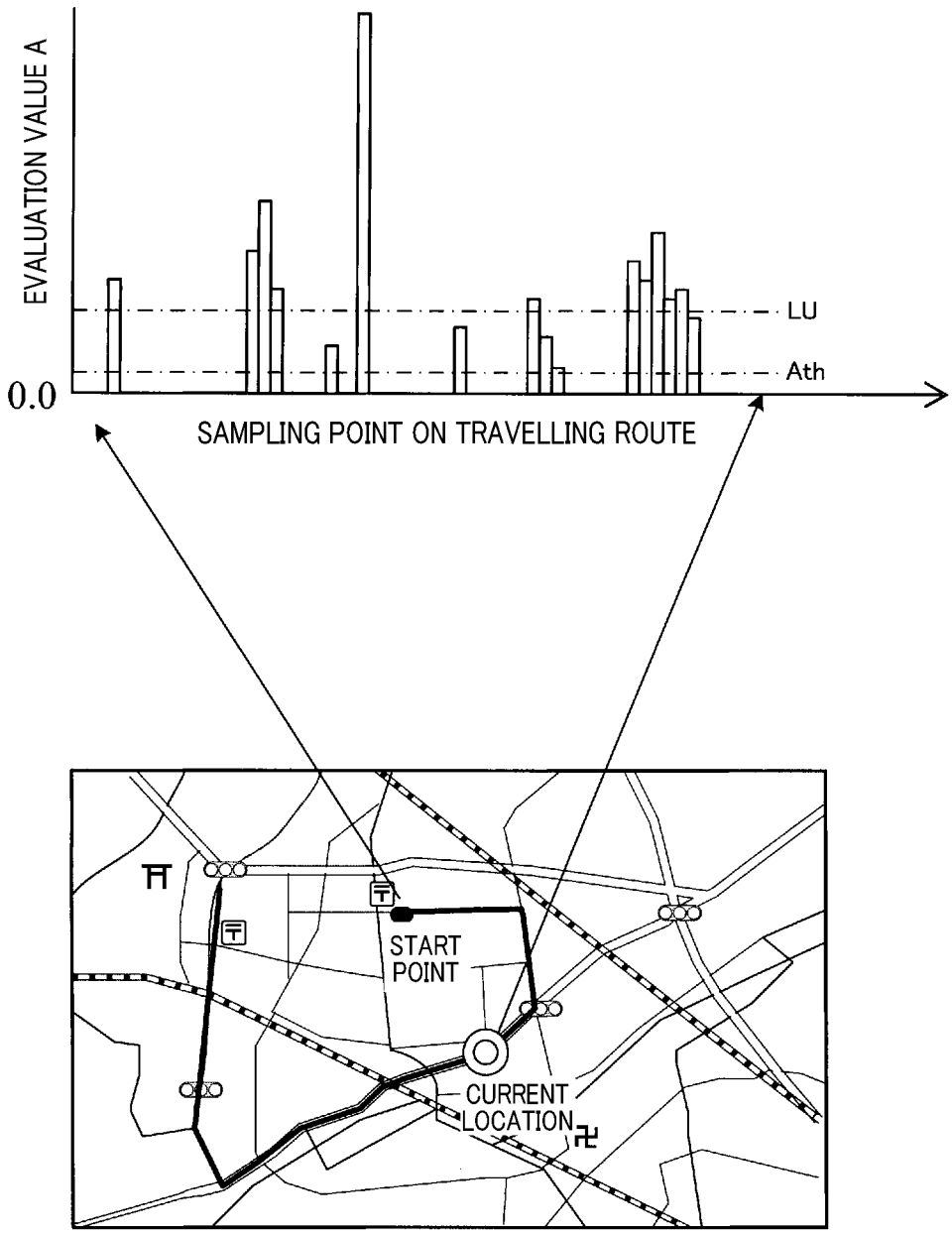
FIG. 9 is a graph schematically illustrating evaluation values at respective sampling points stored in an evaluation storage unit illustrated in FIG. 1.

Following the operation in step S220, the CPU 30*a* calculates the sum of the evaluation values A included in the cumulative range to thereby obtain a cumulative sum E in step S230. If at least one of the evaluation values A included in the cumulative range exceeds an upper limit LU as illustrated in FIG. 9 for example, the CPU 30*a* limits the at least one of the evaluation values A to the upper limit LU, and thereafter calculates the sum of the evaluation values A.

Next, the CPU 30*a* determines whether the cumulative sum E is larger than a predetermined cumulative threshold Eth in step S240. When it is determined that the cumulative sum E is larger than the cumulative threshold Eth (YES in step S240), the specificity determining routine proceeds to step S250. Otherwise, when it is determined that the cumulative sum E is equal to or smaller than the cumulative threshold Eth (NO in step S240), the CPU 30*a* terminates the specificity determining routine.

Following the operation in step S240, the CPU 30*a* determines that the driver's driving of the target vehicle is unusual as compared with the driving operations of other drivers of the vehicles in step S250. Then, the CPU 30*a* generates assist information indicative of the driver's unusual driving of the target vehicle in step S250.

The information sender 36 sends the generated assist information to the target vehicle and some peripheral vehicles travelling around the target vehicle. The information sender 36 can send the generated assist information to one of the target vehicle and some peripheral vehicles travelling around the target vehicle.

When receiving the information receiver 14 of each of the target vehicle and peripheral vehicles, the information provider 15 of the corresponding vehicle provides, to the corresponding driver, the assist information as audible and/or visible information.

As described above, the in-vehicle unit 10 installed in each of the vehicles V1 to Vn in the driving assist system 1 generates, based on the driving behavioral data sequences, a feature data item at each sampling point included in a driving situation. Then, the in-vehicle unit 10 installed in each of the vehicles V1 to Vn sends, to the central server 30, the feature data item at each sampling point together with the index information.

The central server 30 receives the feature data items at each sampling point sent from the in-vehicle units 10 of the vehicles V1 to Vn, and stores the feature data items at each sampling point in the history storage unit 31 to correlate with the corresponding sampling point as historical driving data items.

In particular, the driving evaluator 33 compares, for each of the vehicles V1 to Vn, the feature data item at each sampling point with the historical driving data items at the corresponding sampling point stored in the history storage unit 31. This calculates, for each of the vehicles V1 to Vn, an evaluation value A at each sampling point with respect to the driving of a driver of the corresponding vehicle. Then, the driving evaluator 33 stores, for each of the vehicles V1 to Vn, the evaluation value A at each sampling point in the evaluation storage unit 34 together with the corresponding index information.

Additionally, the unusual driving determiner 35 calculates, for each of the vehicles V1 to Vn, the sum of the evaluation values A stored in the evaluation storage unit 34 along a travelling route of the corresponding vehicle as a cumulative sum E. When the cumulative sum E of a target vehicle in the vehicles V1 to Vn is larger than the cumulative threshold Eth, the unusual driving determiner 35 determines that the driver's driving of the target vehicle is unusual as compared with the other drivers' driving operations of the vehicles. Then, the unusual driving determiner 35 generates assist information indicative of the driver's unusual driving of the target vehicle, and the information sender 36 sends the assist information to the target vehicle and peripheral vehicles travelling around the target vehicle.

When receiving the information receiver 14 of each of the target vehicle and peripheral vehicles, the information provider 15 of the corresponding vehicle displays, on the head-up display, text information or caution marks to draw driver's attention to the target vehicle.

Specifically, when receiving the assist information indicative of the driver's unusual driving of the target vehicle, the information provider 15 of the target vehicle displays, on the head-up display, text information representing "YOUR VEHICLE IS TRAVELLING IN A STRANGE PLACE, YOU SHOULD BE CAREFUL AROUND YOUR VEHICLE (see FIG. 11)"

This enables driving assist for bring the driver of the target vehicle to attention for his/her own driving of the target vehicle to be carried out.

Figure 12:
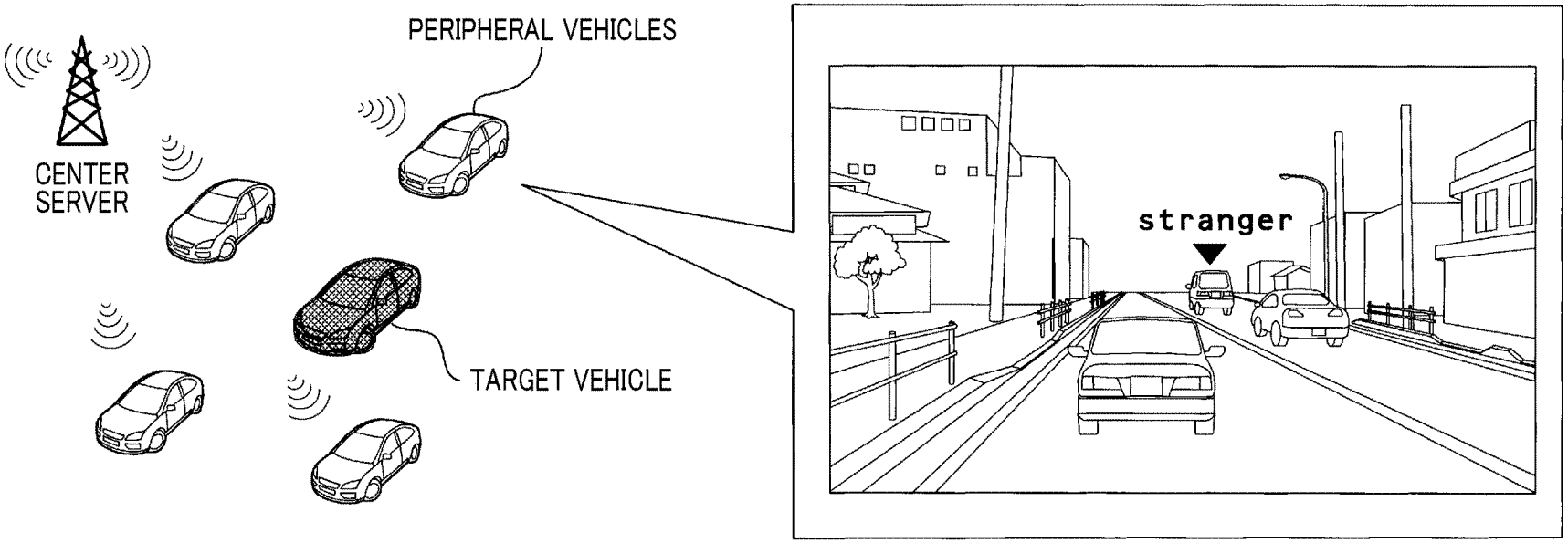
FIG. 12 is a diagram schematically illustrating how the information provider displays, on the display, mark information representing the driver's unusual driving of the target vehicle.

Additionally, when receiving the assist information indicative of the driver's unusual driving of the target vehicle, the information provider 15 of each of the peripheral vehicles displays, on the head-up display, a caution mark "stranger" pointing the target vehicle to be distinguishable from the peripheral vehicles around the target vehicle (see FIG. 12).

This enables driving assist for bring the driver of each of the peripheral vehicles to recognize the target vehicle as a vehicle that the driver should be aware of.

As described above, the driving assist system 1 according to the first embodiment compares, at each sampling point, the feature data item for a target vehicle with the historical driving data items at the corresponding sampling point to thereby obtain the evaluation value A indicative of the degree of alienation from the feature data item to the historical driving data items. Then, the driving assist system 1 calculates the sum of the evaluation values A at the respective sampling points on a travelling route of the target vehicle as the cumulative sum E. When the cumulative sum E is larger than the cumulative threshold Eth, the driving assist system 1 determines that the driver's driving of the target vehicle is unusual.

This configuration enables the specificity of the driver of the target vehicle due to the driver's driving tendency to be identified while eliminating driver's sudden specific operations caused by an ambient environment, such as a road environment, around the target vehicle and/or driver's inattention.

The driving assist system 1 according to the first embodiment is configured to use, as the feature data item, the topic proportion that is comprised of the combination of some values indicative of the tendency of the driving of the driver. This results in a smaller capacity in the history storage unit 31 required to store the historical driving data items.

The driving assist system 1 calculates, as the evaluation value A, a function of the average distance from the feature data item at each sampling point to the historical driving data items at the corresponding sampling point. The average distance serves as a parameter of the alienation from the feature data item at each sampling point to the historical driving data items at the corresponding sampling point. That is, the driving assist system 1 obtains the evaluation value A for a target vehicle at each sampling point on a travelling route of the target vehicle. This configuration enables the driving assist system 1 to determine whether the driving of the driver of the target vehicle is unusual for each of types of roads including intersections, expressways, and urban highways on which the target vehicle is travelling. In addition, this configuration enables the driving assist system 1 to determine whether the driver's driving of the target vehicle is unusual depending on what country or what region the target vehicle is travelling in.

In particular, the driving assist system 1 normalizes the average distance from the feature data item at each sampling point to the historical driving data items at the corresponding sampling point by dividing the average distance by the degree of dispersion of the historical driving data items. This obtains the evaluation value A for each sampling point.

This configuration results in

1. The evaluation value A at a sampling point where most drivers drive their vehicles in substantially a same way being a high value even if the average distance is a low value 2. The evaluation value A at a sampling point where drivers drive their vehicles in different ways being a low value even if the average distance is a high value Upon determining that the evaluation value A at a sampling point is equal to or smaller than the dead-zone threshold Ath, the driving assist system 1 determines that the evaluation value A at the sampling point is within the predetermined dead zone. Then, the driving assist system 1 sets the evaluation value A at the sampling point to zero. This prevents an increase of the cumulative sum E based on the sum of the evaluation values A within the dead zone, which are determined not to be abnormal values. This therefore prevents erroneous determination that a driver of a target vehicle, who is driving in a normal way, is a driver driving in a specific way.

The driving assist system 1 is configured to limit at least one of the evaluation values A to the upper limit LU if the at least one of the evaluation values A included in the cumulative range exceeds the upper limit LU. This configuration eliminates, from the cumulative sum E, the adverse effect based on at least one of the evaluation values A, which is an extremely high value due to a driver's mistake and/or an ambient environment. This therefore emphasizes the effects of the evaluation values A that are repeatedly high values due to the driver's driving tendency in the cumulative sum E.

The driving assist system 1 is configured to send assist information, which represents a driver's unusual driving of a target vehicle, to both the target vehicle and peripheral vehicles travelling around the target vehicle. This is based on the driver's usual view that 1. It is difficult for the driver of the target vehicle to predict the behaviors of the peripheral vehicles 2. It is difficult for the driver of each of the peripheral vehicles to predict the behavior of the target vehicle From this viewpoint, this configuration enables warnings of the specific driving, i.e. unusual driving, of the driver of the target vehicle to be provided to both the driver of the target vehicle and the drivers of the peripheral vehicles. This enables cruising assist for the driver of the target vehicle, who is driving in a strange place.

This configuration also enables cruising assist for the driver of each of the peripheral vehicles except for the target vehicle reducing burdensome warnings to the driver, because the warnings of an unusual driving vehicle are only carried out.

Second Embodiment

Figure 13:
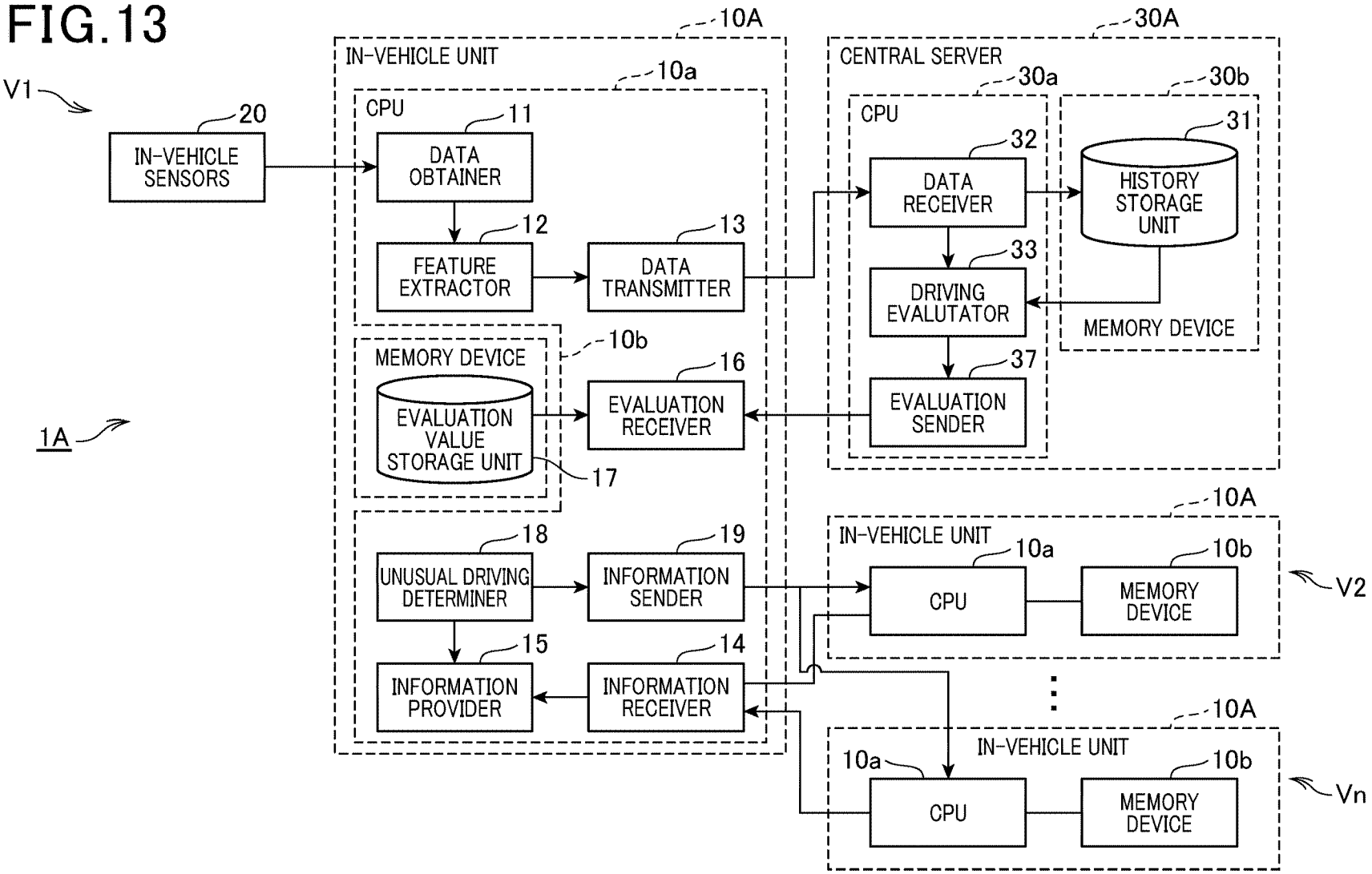
FIG. 13 is a block diagram schematically illustrating an example of the functional structure of a driving assist system according to the second embodiment of the present disclosure.

The following describcentral serveres the second embodiment of the present disclosure with reference to FIG. 13. A driving assist system 1A according to the second embodiment differs from the driving assist system 1 in the following points. So, the following mainly describes the different points of the driving assist system 1A according to the second embodiment, and omits or simplifies descriptions of like parts between the first and second embodiments, to which identical or like reference characters are assigned, thus eliminating redundant description.

The first embodiment is configured such that the central server 30 performs the specificity determining routine illustrated in FIG. 10, and sends the assist information to the target vehicle and the peripheral vehicles around the target vehicle.

In contrast, the second embodiment is configured such that the in-vehicle unit 10A of each of the vehicles V1 to Vn performs the specificity determining routine illustrated in FIG. 10, and provides the assist information to the driver of the corresponding vehicle.

Referring to FIG. 13, the driving assist system 1A includes the in-vehicle units 10A respectively installed in the vehicles V1, . . . , Vn, and a central server 30A communicable by radio with the in-vehicle units 10.

The center server 30A includes the history storage unit 31, the data receiver 32, and the driving evaluator 33, which is similar to the central server 30. The central server 30A additionally includes an evaluation sender 37. That is, eliminating the evaluation storage unit 34, the unusual driving determiner 35, and the information sender 36 from the structure of the central server 30 and adding the evaluation sender 37 to the central server 30 from which these components 34, 35, and 36 have been eliminated enables the central server 30A to be constructed.

The evaluation sender 37 is configured to send, to each of the vehicles V1 to Vn, the evaluation value A for the feature data item sent from the corresponding one of the vehicles V1 to Vn; the evaluation value A is calculated by the driving evaluator 33 at each sampling point.

The in-vehicle unit 10 installed in each of the vehicles V1 to Vn includes the data obtainer 11, the feature extractor 12, the data transmitter 13, the information receiver 14, and the information provider 15.

The in-vehicle unit 10 installed in each of the vehicles V1 to Vn additionally includes an evaluation receiver 16, an evaluation storage unit 17, an unusual driving determiner 18, and an information sender 19.

The evaluation receiver 16 receives the evaluation value A for the feature data item obtained at each sampling point sent from the corresponding vehicle. Then, the evaluation receiver 16 stores, in the evaluation storage unit 17, the received evaluation value A at each sampling point for the corresponding vehicle to correlate with the corresponding index information. This storing task is similar to the storing task executed by the CPU 30 to store the evaluation value A in the evaluation storage unit 34 except that the evaluation receiver 16 stores the received evaluation value A at each sampling point for only the corresponding vehicle in the evaluation storage unit 17.

The unusual driving determiner 18, which is similarly configured to the unusual driving determiner 35, is configured to perform the specificity determination routine set forth above to determine whether a corresponding driver's driving is unusual, i.e. is unique, based on a cumulative sum of the evaluation values A stored in the evaluation storage unit 17.

Upon determining that the corresponding driver's driving of the corresponding vehicle is unusual, the unusual driving determiner 18 generates assist information indicative of the corresponding vehicle driving in an unusual way. Then, the unusual driving determiner 18 supplies the assist information to the information provider 15 and the information sender 19.

Figure 11:
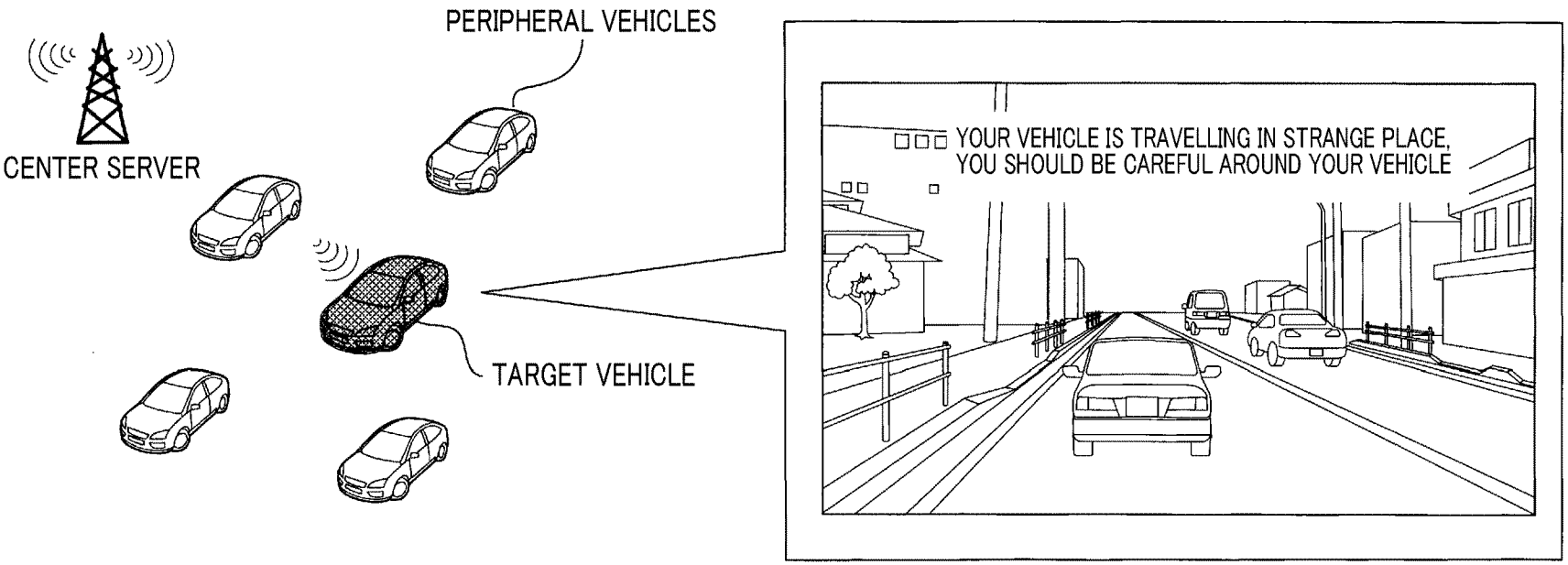
FIG. 11 is a diagram schematically illustrating how an information provider displays, on a display, text information indicative of a driver's unusual driving of a target vehicle.

The information provider 15 of the corresponding vehicle displays, on the head-up display, text information or caution marks to draw driver's attention to the driver's unusual driving of the corresponding vehicle (see FIG. 11).

The information sender 19 of the corresponding vehicle uses vehicle-to-vehicle radio communications to send the assist information generated by the unusual driving determiner 18 to peripheral vehicles located around the corresponding vehicle, which will be referred to as an unusual driving vehicle. When receiving the assist information indicative of the driver's unusual driving of the unusual driving vehicle, the information provider 15 of each of the peripheral vehicles displays, on the head-up display, caution information to draw the driver's attention to the unusual driving vehicle.

As described above, the driving assist system 1A according to the second embodiment achieves the same advantageous effects as those achieved by the driving assist system 1.

Additionally, the driving assist system 1A results in lower processing load of the central server 30A than the processing load of the central server 30.

The driving assist system 1A prevents a significant increase in the processing load of each of the in-vehicle units 10A, because each of the in-vehicle units 10A is configured to perform determination of whether the driver's driving of the own vehicle is unusual only, i.e., not for other vehicles.

The in-vehicle unit 10A of the specific driving vehicle uses vehicle-vehicle radio communications to easily send the assist information to the peripheral vehicles without via the central server 30A. This eliminates the need for the central server 30A to recognize the peripheral vehicles to which the assist information is sent from the specific driving vehicle. This facilitates the functions of the central server 30A as a function of calculating the evaluation values A and sending the evaluation values A to each of the vehicles V1 to Vn. This enables the functional structure of the central server 30A to be simplified.

The present disclosure is not limited to the descriptions of each of the first and second embodiments, and the descriptions of each of the first and second embodiments can be widely modified within the scope of the present disclosure.

The feature extractor 12 obtains a topic proportion as a driving data item for each of the driving situations, but the present disclosure is not limited thereto. Specifically, the feature extractor 12 can obtain a driving data item for each of sections on a travelling road of a corresponding vehicle; each of the sections has a constant length. The feature extractor 12 also can obtain a driving data item for each of sections on a travelling road of a corresponding vehicle; the travelling road is partitioned in accordance with a predetermined rule to constitute the sections.

Each of the first and second embodiments uses topic proportions as the feature data items, but the present disclosure is not limited thereto. Specifically, each of the first and second embodiments can use segmented behavior-data sequences as the feature data items, or use a distribution of features included in each of the segmented behavior-data sequences as a feature data item.

The functions of one element in each of the first and second embodiments can be distributed as plural elements, and the functions that plural elements have can be combined into one element. At least part of the structure of each of the first and second embodiments can be replaced with a known structure having the same function as the at least part of the structure of the corresponding embodiment. A part of the structure of each of the first and second embodiments can be eliminated. At least part of the structure of each of the first and second embodiments can be added to or replaced with the structures of the other embodiment. All aspects included in the technological ideas specified by the language employed by the claims constitute embodiments of the present invention.

The present disclosure can be implemented by various embodiments in addition to the driving assist system; the various embodiments include driving assist systems each including in-vehicle units and a central server, programs for serving a computer as each of the in-vehicle units and the central server, storage media storing the programs, and driving assist methods.

While the illustrative embodiment of the present disclosure has been described herein, the present disclosure is not limited to the embodiment described herein, but includes any and all embodiments having modifications, omissions, combinations (e.g., of aspects across various embodiments), adaptations and/or alternations as would be appreciated by those having ordinary skill in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. A driving assist system comprising:

a data obtainer configured to:

obtain, from each of a plurality of vehicles, a driving feature data item sampled at each predetermined sampling point on a travelling route of the corresponding vehicle, the driving feature data items obtained from each of the plurality of vehicles being based on at least one of at least one driver's operation to the corresponding vehicle, and at least one behavior of the corresponding vehicle;

a first storage unit storing, as historical driving data items, the driving feature data items that have been previously obtained from each of the plurality of vehicles, the historical driving data items obtained from each of the plurality of vehicles having been sampled at the respective sampling points on the corresponding travelling route;

a driving evaluator configured to:

compare the driving feature data item sampled at each predetermined sampling point and obtained from a target vehicle included in the plurality of vehicles with the historical driving data items for the corresponding sampling point stored in the first storage unit; and obtain, based on a result of the comparison, an evaluation value of the driving feature data item for the target vehicle at each predetermined sampling point, the evaluation value of the driving feature data item for the target vehicle at each predetermined sampling point representing a degree of alienation of the driving feature data item from the historical driving data items at the corresponding sampling point;

a second storage unit configured to store the evaluation value of the driving feature data item for the target vehicle at each predetermined sampling point; and an unusual driving determiner configured to:

obtain a cumulative sum of selected values in the evaluation values of the driving feature data items for the target vehicle, the selected values corresponding to respectively selected sampling points included in the sampling points;

determine whether the cumulative sum of the selected values in the evaluation values of the driving feature data items for the target vehicle is larger than a predetermined threshold; and determine that driving of a driver of the target vehicle is unusual upon determining that the cumulative sum of the selected values in the evaluation values of the driving feature data items for the target vehicle is larger than the predetermined threshold.

2. The driving assist system according to claim 1, wherein:

the unusual driving determiner is configured to obtain the cumulative sum of the selected values in the evaluation values of the driving feature data items for the target vehicle, the selected values corresponding to respectively selected sampling points included in the sampling points, the selected sampling points being included in a predetermined cumulative range, the predetermined cumulative region being set on the travelling route of the target vehicle.

3. The driving assist system according to claim 1, wherein:

the driving evaluator is configured to normalize the evaluation value of the driving feature data item for the target vehicle at each predetermined sampling point using a degree of dispersion of the historical driving data items at the corresponding sampling point such that:

the higher the degree of dispersion of the historical driving data items is, the lower the evaluation value of the driving feature data item is.

4. The driving assist system according to claim 1, wherein:

the driving evaluator is configured to:

determine whether the evaluation value of the driving feature data item for the target vehicle at each predetermined sampling point is equal to or smaller than a predetermined dead-zone threshold; and set the evaluation value of the driving feature data item for the target vehicle at one of the predetermined sampling points to zero based on determining that the evaluation value of the driving feature data item for the target vehicle at the corresponding one of the predetermined sampling points is equal to or smaller than the predetermined dead-zone threshold.

5. The driving assist system according to claim 1, wherein:

the unusual driving determiner is configured to:

determine whether the evaluation value of the driving feature data item for the target vehicle at each predetermined sampling point exceeds a predetermined upper limit; and limit the evaluation value of the driving feature data item for the target vehicle at one of the predetermined sampling points to the upper limit based on determining that the evaluation value of the driving feature data item for the target vehicle at the corresponding one of the predetermined sampling points exceeds the upper limit.

6. The driving assist system according to claim 1, wherein:

the data obtainer is configured to:

obtain, from each of the plurality of vehicles, driving-behavioral data sequences including at least one of the driver's operation to the corresponding vehicle, and the behavior of the corresponding vehicle;

discretize the driving-behavioral data sequences into a plurality of segmented behavior-data sequences, each of the segmented behavior-data sequences representing a corresponding one of driving situations; and extract, from each of the segmented behavior-data sequences, the driving feature data item for the corresponding one of the driving situations.

7. The driving assist system according to claim 6, wherein:

the data obtainer is configured to:

store information indicative of a plurality of driving topics, each of the driving topics representing a basic driving situation;

select driving topics in all the stored driving topics for each of the driving situations, the selected driving topics for each of the driving situations expressing typical feature patterns included in the corresponding driving situation; and generate a mixture of percentages of the selected driving topics for each of the driving situations to generate a topic proportion as the driving feature data item for the corresponding one of the driving situations.

8. The driving assist system according to claim 1, further comprising:

an information provider configured to, based on determining that the driving of the driver of the target vehicle is unusual, provide, to at least one of the driver of the target vehicle and a driver of at least one other vehicle in the plurality of vehicles, assist information based on the driver's unusual driving of the target vehicle.

9. The driving assist system according to claim 8, wherein:

the information provider is configured to visually or audibly provide the assist information to the driver of the target vehicle, the assist information notifying the driver of the target vehicle of the driver's unusual driving of the target vehicle.

10. The driving assist system according to claim 8, wherein:

the information provider is configured to visually or audibly provide the assist information to the driver of the at least one other vehicle, the at least one other vehicle being located around the target vehicle, the assist information notifying the driver of the at least one other vehicle of the driver's unusual driving of the target vehicle.

* * * * *